US006914206B2

(12) United States Patent
Mukougawa

(10) Patent No.: US 6,914,206 B2
(45) Date of Patent: Jul. 5, 2005

(54) OPERATION BUTTON FIXING STRUCTURE OF ELECTRIC DEVICE

(75) Inventor: Hidenobu Mukougawa, Fukui (JP)

(73) Assignee: Orion Electric Co., Ltd., Fukui (JP)

( * ) Notice: Subject to any disclaimer, the term of this patent is extended or adjusted under 35 U.S.C. 154(b) by 0 days.

(21) Appl. No.: 10/659,330

(22) Filed: Sep. 11, 2003

(65) Prior Publication Data

US 2004/0066120 A1 Apr. 8, 2004

(30) Foreign Application Priority Data

Sep. 12, 2002 (JP) ..... 2002-266576

(51) Int. Cl.[7] ..... H01H 21/00; H01H 3/20

(52) U.S. Cl. ..... 200/556; 200/552; 200/341; 200/332

(58) Field of Search ..... 200/556, 552, 200/341–345, 329–332.2, 293, 296, 520, 5 R, 17 R

(56) References Cited

U.S. PATENT DOCUMENTS 5,947,267 A * 9/1999 Kee et al. ..... 200/332
6,051,768 A * 4/2000 Masubuchi ..... 84/433
6,054,662 A * 4/2000 Hrehor et al. ..... 200/332
6,492,605 B2 * 12/2002 Iida ..... 200/343
6,570,111 B2 * 5/2003 Nakagawa et al. ..... 200/343

FOREIGN PATENT DOCUMENTS

JP 7-141961 6/1995

* cited by examiner

*Primary Examiner*—K. Richard Lee
(74) *Attorney, Agent, or Firm*—Wenderoth, Lind & Ponack, L.L.P.

(57) ABSTRACT

In order to facilitate fixing an operating button to the front panel of an electric device, the operation button includes a rectangular frame having at least one engagement piece integrally connected to and extending downwards from its bottom side. The operation button can be fixedly held on the lower side by press-fitting the engagement piece into an associated engagement slot made in the bottom plate of the cabinet. The front panel has at least one tapped boss fixed to its rear side, thereby allowing the frame to be screwed on the upper side to the tapped boss. Alternatively, the front panel has at least one apertured engagement piece fixed to its rear side, whereas the frame has at least one yieldingly bendable curved hook integrally connected to its upper side. The curved hook has a nail formed at its free end. The upper side of the operation button is fixed to the front panel by press-fitting the nail of the curved hook in the aperture of the engagement piece of the front panel.

15 Claims, 8 Drawing Sheets

OPERATION BUTTON FIXING STRUCTURE OF ELECTRIC DEVICE

BACKGROUND OF THE INVENTION

1. Field of the Invention

The present invention relates to an operation button fixing structure of an electric device.

2. Related Art

Electric devices have buttons necessary for operation on their fronts. Such a button is operatively connected to a switch in the circuit board, so that when the button is depressed, it may make the associated switch turn on or off. The circuit board is mounted on the chassis of the electric device. When fixing the operation button to the front panel of the electric device, the operation button needs to be aligned with the switch, which is fixed to the circuit board. Exact alignment is required, and therefore there has been an ever-increasing demand for making it easy to fix operation buttons to the front panels in exact alignment with the associated switches.

To meet such demand JP7-141961(A) discloses an "Operation button Mounting Structure" where an operation button to be pressed has a hook piece integrally to be caught with its front panel of the cabinet and the front panel has a counter hook to catch the hook piece at its rear side. The operation button is fixedly held on the rear side of the front panel by engaging the hook of the button with the counter hook of the front panel. The operation button can be easily fixed to the front panel, but it can be unhooked to come off from the front panel.

FIG. 6 shows another conventional operation button fixing structure. As shown, an operation button unit 1 is fixed to the rear side of the front panel 2 of the cabinet The front panel 2 has four tapped bosses 4 integrally connected to its rear side, and the operation button unit 1 is fastened to the four tapped bosses 4 by screwing the four corners of a frame 3. Thus, the frame 3 is apart from the rear side of the front panel 2 by the distance equal to the length of the boss 4.

The operation button unit 1 has two button assemblies 5, 5 encircled by its frame 3, and each button assembly 5 is connected to the frame 3 via hinge 6. Each button assembly 5 has an arm 8 extending backwards until its free end comes to contact with an associated switch 10, which is mounted on a circuit board 9. When either button assembly 5 is depressed, its arm 8 inclines about the hinge 6 to push the associated switch 10 with its free end.

FIG. 7*a* is a rear view of the front panel 2 having the operating button unit 1 mounted on its rear side; FIG. 7*b* is a sectional view of the front panel-and-operation button combination taken along the line 7*b* —7*b* in FIG. 7*a*; and FIG. 7*c* is another sectional view of the front panel-and-operation button combination taken along the line 7*c*—7*c* in FIG. 7*a*. As seen from these drawings, the frame 3 is screwed to the bosses 4, which project backwards from the rear side of the front panel 2. Each button 11 projects forward from the upright base piece 7 of the button assembly 5, passing through the hole 12 made in the front panel 2. As seen from FIGS. 7*b* and 7*c*, the button 11 partly appears from the front side of the front panel 2. With this arrangement, when the button 11 is depressed, the upright base piece 7 is yieldingly inclined about the hinge 6 to make the arm end contact with the switch 10.

As the operation button unit 1 is screwed to the rear side of the front panel, it cannot come off from the front panel.

The operation button, however, cannot be fixed to the front panel with ease. FIG. 8 illustrates how the operation button 1 can be fixed to the rear side of the front panel 2, and how the circuit board 9 can be fixed to the bottom plate of the cabinet of the electric device. First, the operation button 1 is screwed to the front panel 2, and then, the circuit board 9 is fixed to the bottom plate (chassis). In the example shown in the drawing, four screws are used in fixing the operation button 1 to the front panel 2. The number of screws will increase with the increase in the number of the operation buttons to be fixed to the rear side of the front panel 2, and accordingly, the fixing work will be increasingly tedious. Further, the fixing work with use of screws will be more tedious and difficult when the space between the operation buttons and the bottom plate is narrow in an electric device such as a television.

In view of the above, one object of the present invention is to provide an operation button fixing structure which is capable of readily fixing an operation button to the front panel without fear of loosening and coming apart from the front panel.

SUMMARY OF THE INVENTION

To attain this object a structure for fixing an operation button unit to a rear side of a front panel of a cabinet of an electric device, the operation button unit comprising a frame and at least one operation button hinged to the frame, the hinge for fixing the operation button to the frame being responsive to a push given to the operation button on the front side of the front panel for yieldingly bending, allowing the operation button to work, is improved according to the present invention in that the frame has at least one engagement piece extending downwards from the bottom side of the frame to be press-fitted into an associated engagement slot made in a bottom plate of the cabinet, and the front panel has at least one tapped boss fixed to its rear side, thereby allowing the frame to be screwed on the upper side to the tapped boss.

A structure for fixing an operation button unit to rear side of a front panel of a cabinet of an electric device, the operation button unit comprising a frame and at least one operation button hinged to the frame, the hinge for fixing the operation button to the frame being responsive to a push given to the operation button on the front side of the front panel for yieldingly bending, allowing the operation button to work, is improved according to the present invention in that the frame has at least one engagement piece integrally connected to and extending downwards from the bottom side of the frame to be press-fitted into an associated engagement slot made in a bottom plate of the cabinet, and the frame has at least one yieldingly bendable curved hook integrally connected to its upper side, the curved hook having a nail formed at its free end, and the front panel having an apertured engagement piece extending backwards from its rear side, thus allowing the nail of the curved hook to fit in the aperture of the engagement piece when the curved hook is pushed against the engagement piece.

Other objects and advantages of the present invention will be understood from the following description of two embodiments of the present invention, which are shown in accompanying drawings.

DETAILED DESCRIPTION OF PREFERRED EMBODIMENTS

Figure 1:
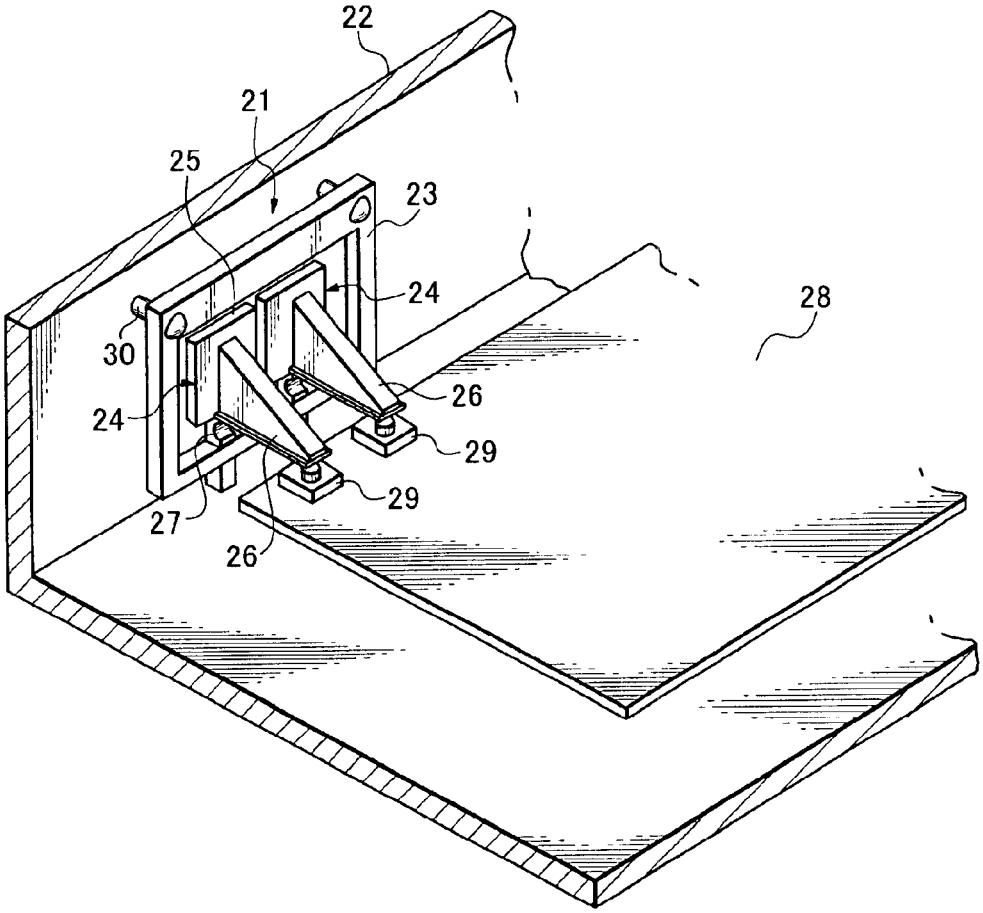
FIG. 1 is a perspective view of an operation button fixing structure according to a first embodiment of the present invention.
Figure 2A:
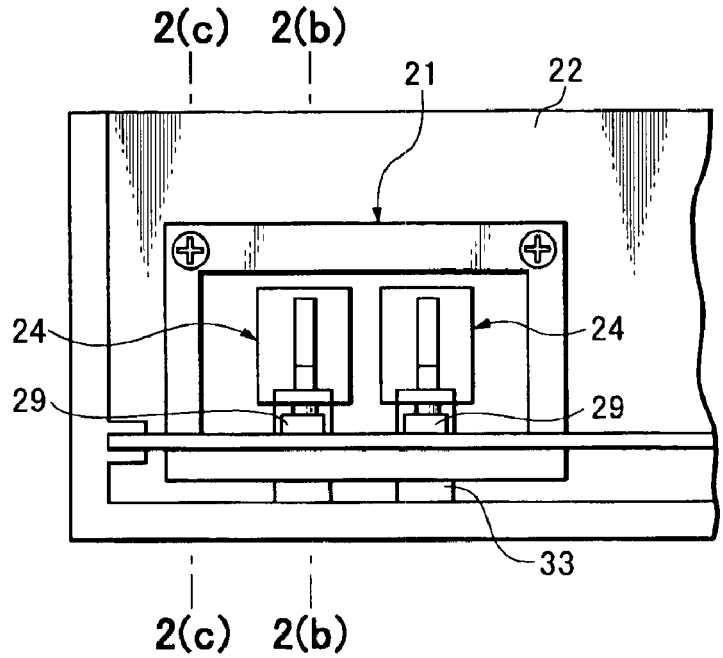
FIG. 2(*a*) is a rear view of the front panel having the operation button fixing structure attached to its rear side.
FIG. 2*b* is a sectional view taken along the line 2(*b*)—2(*b*) in FIG. 1.
FIG. 2*c* is a sectional view taken along the line 2(*c*)—2(*c*) in FIG. 1.
Figure 2B:
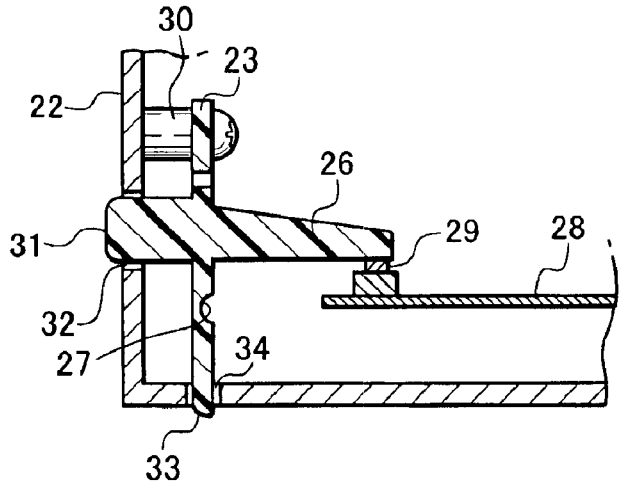
Figure 2C:
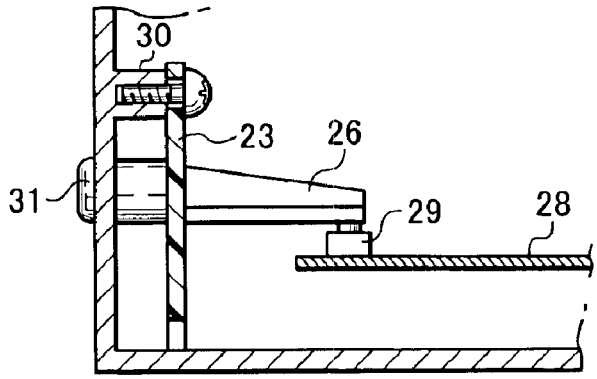
Figure 3:
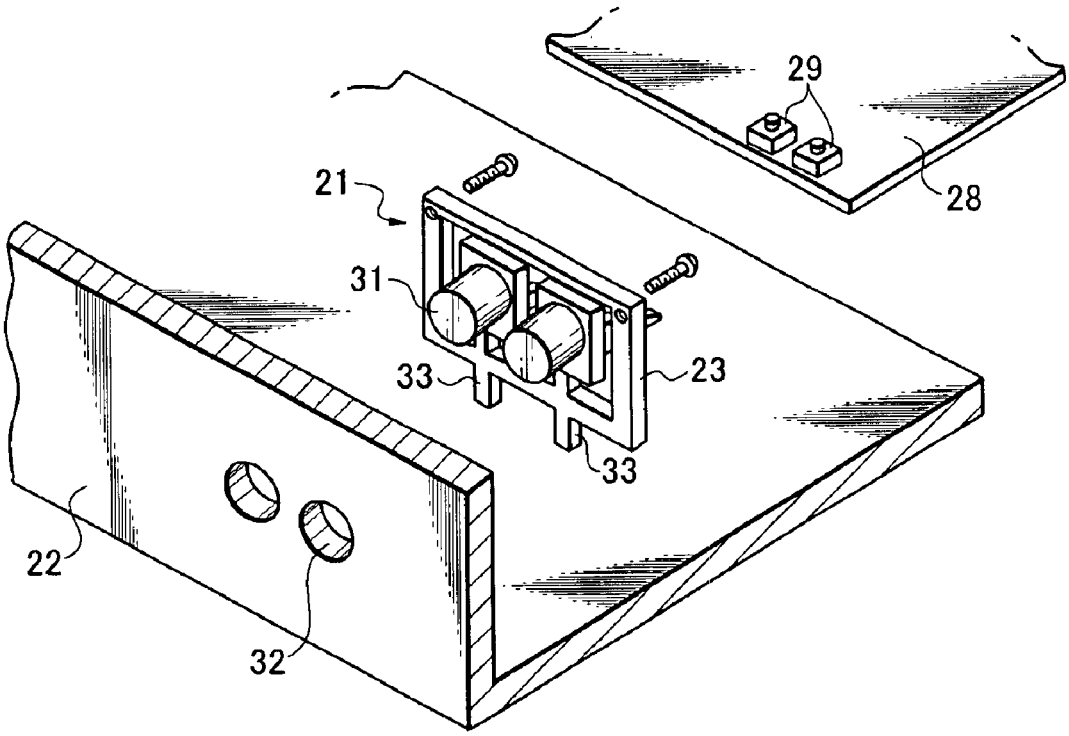
FIG. 3 illustrates how the operation button unit can be fixed to the front panel.

FIGS. 1 to 3 shows a structure for fixing an operation button unit 21 to the rear side of the front panel 22 of the cabinet of an electric device according to the first embodiment of the present invention. The operation button unit 21 includes a frame 23 and two button assemblies 24, 24. Each button assembly 24 has an upright base 25, a button 31 extending forward from the front side of the upright base 25, and an arm 26 integrally connected to the rear side of the upright base 25, extending backward. The upright base 25 is connected integrally to the frame 23 via a hinge 27 (see FIG. 2*b*). The button 31 is fitted in an associated hole 32 made in the front panel 22 to partly appear on the front side of the front panel 22, thus permitting access to the button assembly 24.

Figure 6:
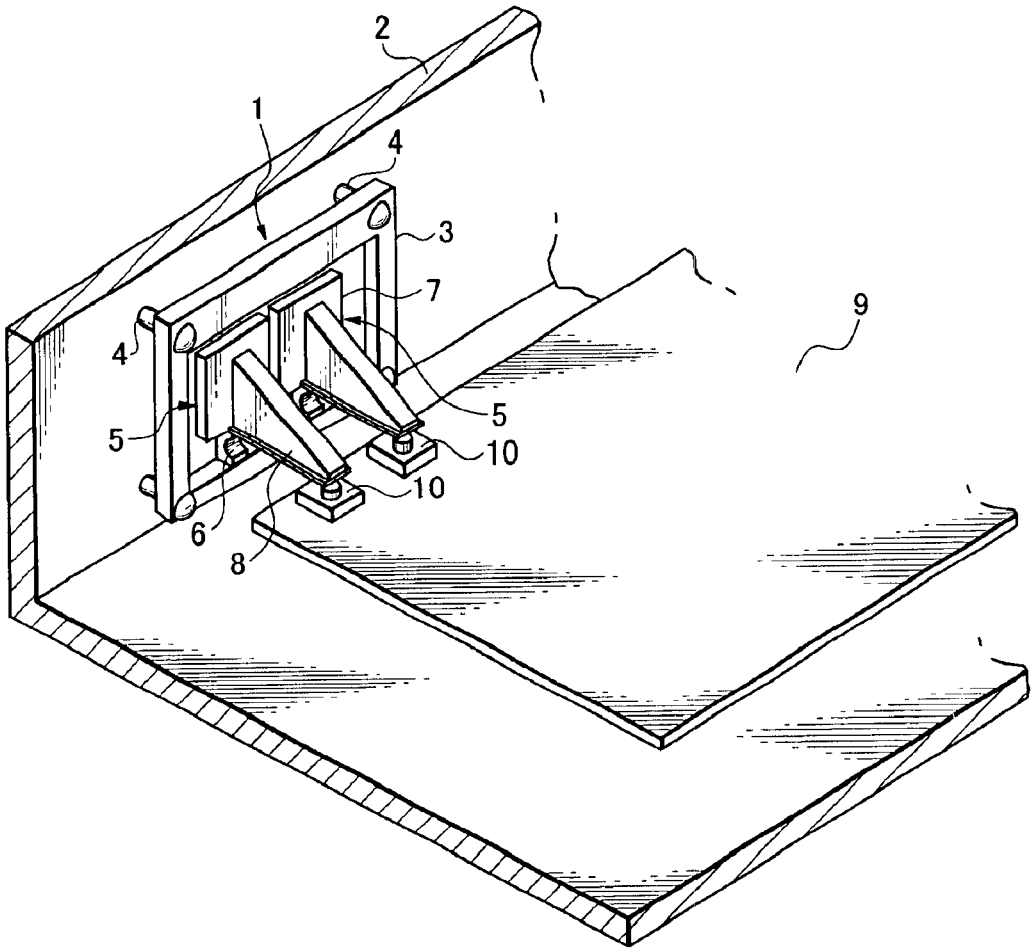
Fig. 6 PRIOR ART
FIG. 6 is a perspective view of a conventional operation button fixing structure.
Figure 7A:
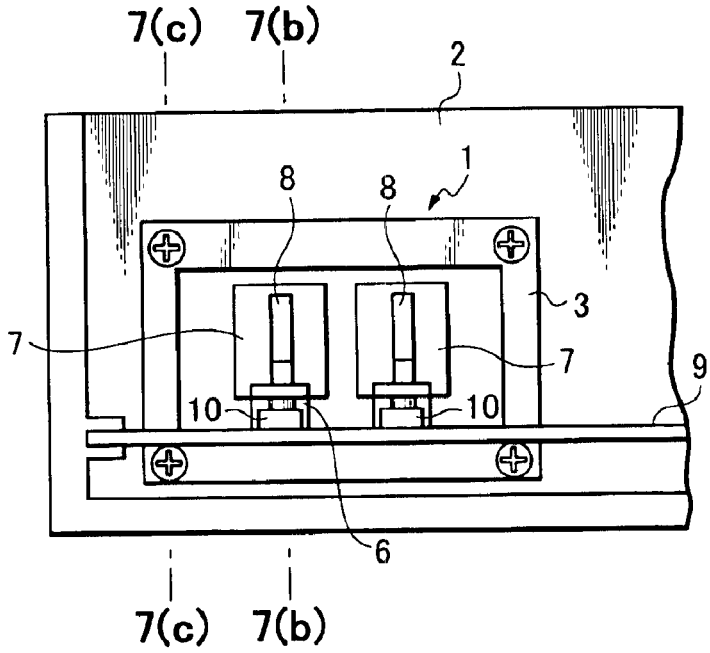
Fig. 7(a) PRIOR ART
FIG. 7*a* is a rear view of the front panel having the conventional operation button fixing structure attached to its rear side.
Figure 7B:
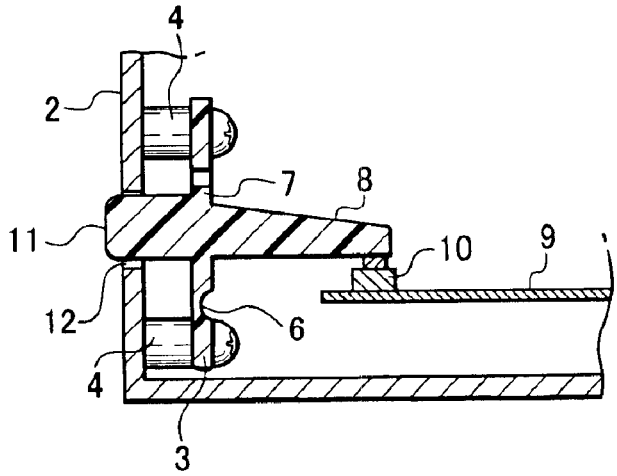
Fig. 7(b) PRIOR ART
FIG. 7*b* is a sectional view taken along the line 7(*b*)—7(*b*) in FIG. 7*a;*
Figure 7C:
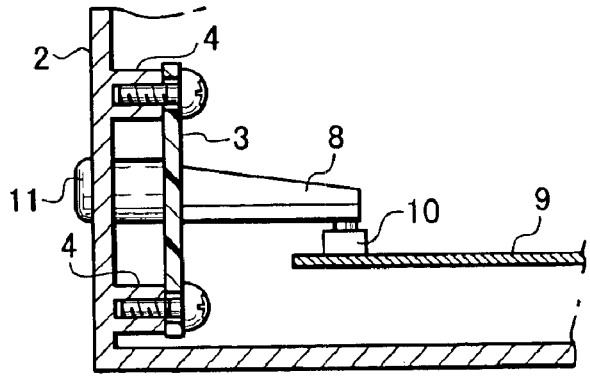
Fig. 7(c) PRIOR ART
FIG. 7*c* is another sectional view taken along the line 7(*c*)—7(*c*) in FIG. 7*a*.
Figure 8:
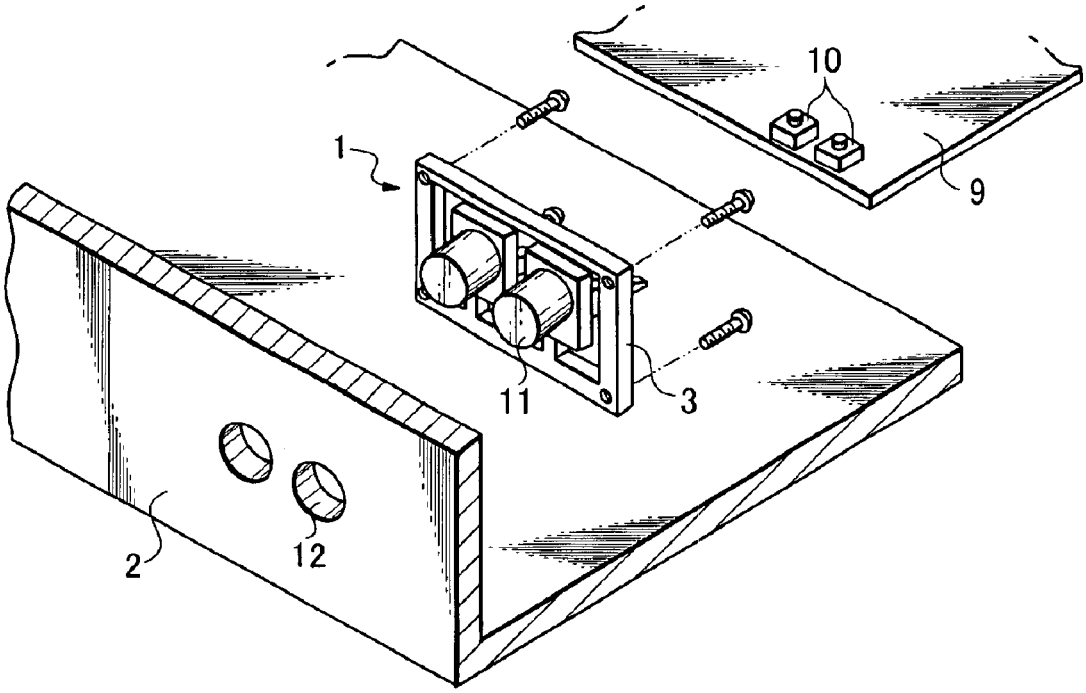
Fig. 8 PRIOR ART
FIG. 8 illustrates how the conventional operation button unit can be fixed to the front panel.

The cabinet has a circuit board 28 laid on its bottom plate, and the circuit board 28 has switches 29 mounted thereon. As seen from FIG. 1, each arm 26 has its free end put on the associated switch 29. The structure of the operation button unit 21 described so far is the same as in FIG. 6. The hinge 27 connecting the button assembly 24 to the frame 23 is responsive to a push given to the button assembly 24 on the front side of the front panel 22 for yieldingly bending, allowing the button assembly 24 to work on an associated switch 29 via its arm 26 for turning the switch 29 "on" or "off".

As seen from FIGS. 2(*b*) and 2(*c*), the front panel 22 has tapped bosses 30 integrally connected to its rear side, and the frame 23 is screwed by its upper opposite corners, so that the button 31 projecting from its upright base pieces 25 may be inserted in the holes 32 made in the front panel 22. With this arrangement the hinge 27 will be yieldingly bent in response to depression of the button assembly 24, allowing the arm 26 to incline and push the associated switch 29 for turning the switch 29 "on" or "off".

As seen from FIGS. 2(*a*) and 2(*b*), the frame 23 has engagement pieces 33, 33 integrally connected to and extending downward from the bottom side of the frame 23. These engagement pieces 33, 33 can be press-fitted into associated engagement slots 34, 34, which are made in the bottom plate of the cabinet. As mentioned earlier, the frame 23 is screwed on the upper side to the tapped bosses 30.

FIG. 3 illustrates the manner in which the operation button unit 21 and the circuit board 28 are fixed to the rear side of the front panel 22 and bottom plate of the cabinet respectively. First, the operation button unit 21 is readily fixed by screwing the upper, opposite corners of the frame 23 to the tapped bosses 30 and by press fitting the engagement pieces 33 into the slots 34. Then, the circuit board 28 is fixed to the bottom of the cabinet with its switches 29 aligned with the free ends of the arms 26, 26 of the operation button unit 21.

Figure 4:
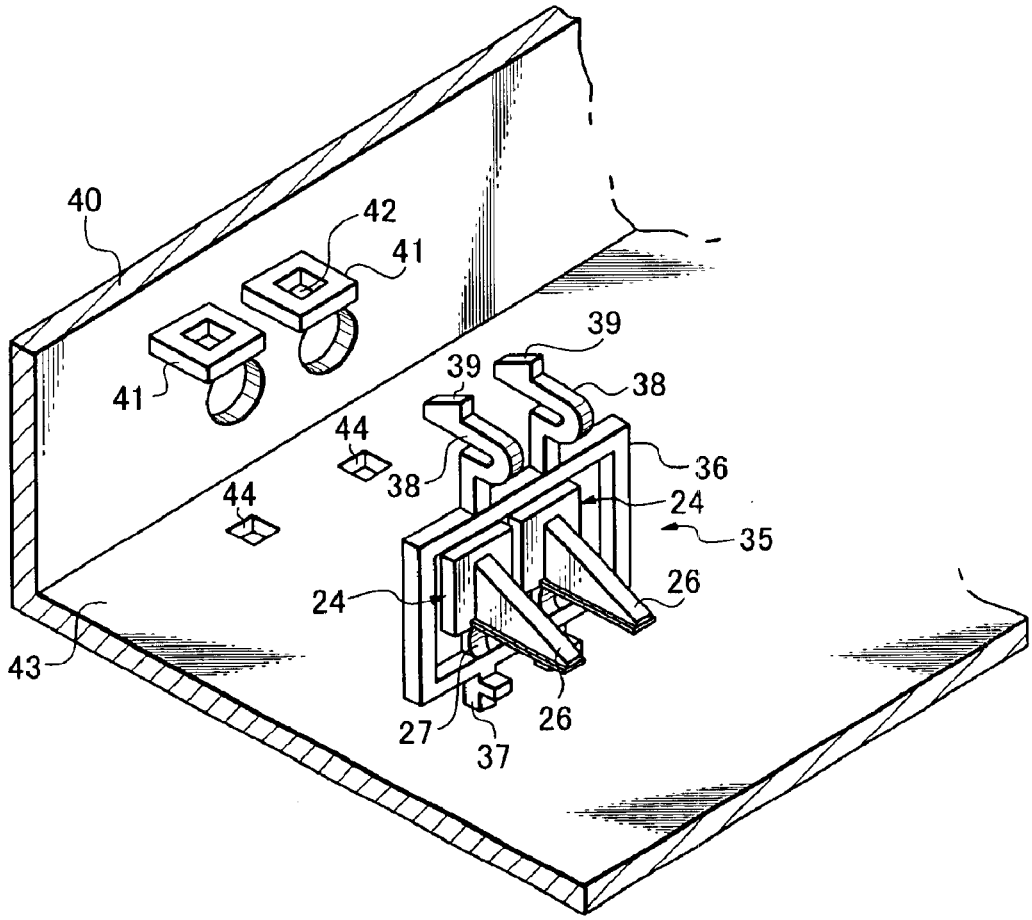
FIG. 4 is a perspective view of an operation button fixing structure according to a second embodiment of the present invention.

FIG. 4 shows another embodiment of the present invention. The operation button unit 35 includes a rectangular frame 36 having two button assemblies 24, 24 hinged to its bottom side. Also, the frame 36 has two engagement pieces 37, 37 integrally connected to and extending downwards from its bottom side, and two yieldingly bendable curved hooks 38, 38 integrally connected to its upper side. The curved hook 38 has a nail 39 formed at its free end. The front panel 40 has apertured engagement pieces 41, 41 integrally connected to and extending backward from its rear side. Each engagement piece 41 has an aperture 42 made therein, thus allowing the nail 39 of the curved hook 38 to fit in the aperture 42 when the curved hook 38 is pushed against the engagement piece 41.

Each button assembly 24 has its upright base 25 connected to the frame 36 via the hinge 27. The upright base 25 has a button 31 and an arm 26 projecting forward and backward respectively, as is the case with the first embodiment.

Figure 5:
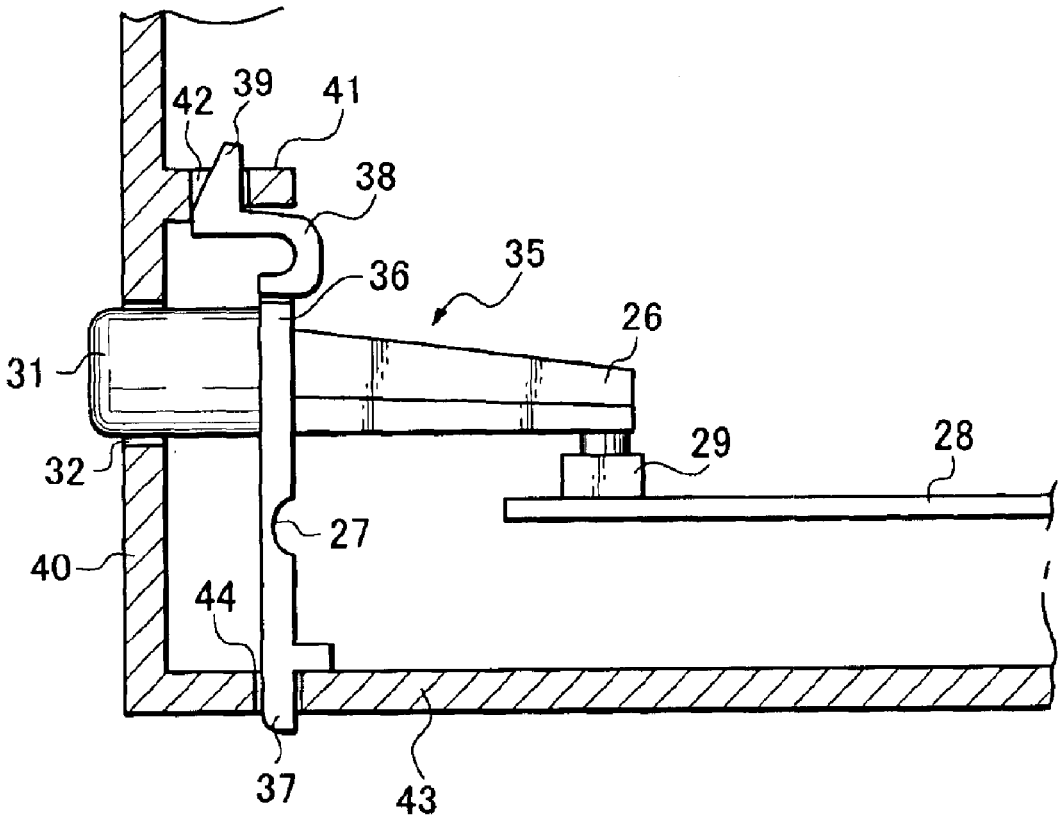
FIG. 5 is a sectional view of the operation button fixing structure of FIG. 4.

FIG. 5 shows the operation button unit 35 as being fixed to the rear side of the front panel 40. As shown, it is fixed to the front panel 40 by allowing its hook nails 39, 39 to be caught in the apertures 42, 42 of the engagement pieces 41, 41, and at the same time, it is fixed to the bottom plate 43 by press-fitting its engagement pieces 37 into the slots 44, 44, which are made in the bottom plate 43. The hook 38 can be yieldingly bent to allow its nail 39 to fit in the aperture 42 of the engagement piece 41, so that the hook 38 may be resiliently held by the engagement piece 41 without the fear of loosening.

When the operation button unit 35 is fixed, first, the nails 39, 39 of the curved hooks 38, 38 are inserted in the apertures 42, 42 of the engagement pieces 41, 41, and then, the engagement pieces 37, 37 of the frame 36 are inserted in the slots 44, 44 of the bottom plate 43 while the curved hooks 38 are yieldingly deformed.

As may be understood from the above, the operation button unit according to the present invention can be readily fixed to the rear side of the front panel and bottom plate of the cabinet of an electric device; the lower side of the operation button unit can be readily fixed to the bottom plate of the housing simply by inserting the engagement pieces of the frame into the slots made in the bottom plate. As for the first embodiment the upper side of the operation button are screwed to the front panel, which is much easier than screwing the lower side to the front panel. And, as for the second embodiment the upper part of the operation button unit can be fastened simply by inserting the curved hook into the aperture of the engagement piece projecting backward from the rear side of the front panel.

What is claimed is:

1. A structure for fixing an operation button unit to a rear side of a front panel of a cabinet of an electric device, the operation button unit comprising a frame and at least one operation button hinged to the frame, the hinge for fixing the operation button to the frame being responsive to a push given to the operation button on the front side of the front panel for yieldingly bending, allowing the operation button to work, wherein the frame has at least one engagement piece integrally connected to and extending downwards from the bottom side of the frame to be press-fitted into an associated engagement slot made in a bottom plate of the cabinet, and the frame has at least one yieldingly bendable curved hook integrally connected to its upper side, the curved hook having a nail formed at its free end, and the front panel having an apertured engagement piece extending backwards from its rear side, thus allowing the nail of the curved hook to fit in the aperture of the engagement piece when the curved hook is pushed against the engagement piece.

2. A structure of an operation button unit arrangement, comprising:

a cabinet structure including a front panel and a bottom plate;

an operation button unit including an operation button, a unitary frame member surrounding said operation button and having a through-hole formed in an upper side, and a hinge yieldingly fixing said operation button to said unitary frame member such that, upon a push being imparted to said operation button, said hinge yields to allow said operation button to be depressed relative to said unitary frame member; and a fastener inserted through said through-hole in said upper side of said unitary frame member to fix said upper side of said unitary frame member to said front panel;

wherein said bottom plate of said cabinet structure has an engagement slot formed therein; and wherein an engagement piece extends downward from a bottom side of said unitary frame member to be press-fitted in said engagement slot of said bottom plate of said cabinet structure, whereby said unitary frame member is fixed to said bottom plate of said cabinet structure by engagement of said engagement piece in said engagement slot, and to said front panel by said fastener.

3. The structure according to claim 2, further comprising a tapped boss fixed to a rear side of said front panel; and wherein said fastener comprises a threaded fastener inserted through said through-hole in said upper side of said unitary frame member and screwed to said tapped boss.

4. The structure according to claim 3, wherein said hinge is connected between said operation button and a bottom side of said unitary frame member.

5. The structure according to claim 3, wherein said engagement slot comprises an engagement hole formed through said bottom plate of said cabinet structure.

6. The structure according to claim 3, wherein said operation button constitutes part of an operation button assembly; and said operation button assembly further includes an upright base, said operation button projecting forward from said upright base, and an arm connected to a rear side of said upright base and extending rearward to press a switch when a push is imparted to said operation button.

7. The structure according to claim 2, wherein said hinge is connected between said operation button and a bottom side of said unitary frame member.

8. The structure according to claim 2, wherein said engagement slot comprises an engagement hole formed through said bottom plate of said cabinet structure.

9. The structure according to claim 2, wherein said operation button constitutes part of an operation button assembly; and said operation button assembly further includes an upright base, said operation button projecting forward from said upright base, and an arm connected to a rear side of said upright base and extending rearward to press a switch when a push is imparted to said operation button.

10. A structure of an operation button unit arrangement, comprising:

a cabinet structure including a front panel and a bottom plate;

an operation button unit including an operation button, a frame member, and a hinge yieldingly fixing said operation button to said frame member such that, upon a push being imparted to said operation button, said hinge yields to allow said operation button to be depressed relative to said frame member; and wherein said bottom plate of said cabinet structure has an engagement slot formed therein;

wherein a frame engagement piece extends downward from a bottom side of said frame member to be press-fitted in said engagement slot of said bottom plate of said cabinet structure;

wherein a yieldingly bendable curved hook is integrally connected to an upper side of said frame member, said curved hook having a nail formed at its free end; and wherein a panel engagement piece extends rearward from a rear side of said front panel, said panel engagement piece having an aperture therein, thus allowing said nail of said curved hook to fit in said aperture of said panel engagement piece when said curved hook is pushed against said panel engagement piece, whereby said frame member is fixed to said bottom plate of said cabinet structure by engagement of said frame engagement piece in said engagement slot, and to said front panel by engagement of said nail of said curved hook in said panel engagement piece.

11. The structure according to claim 10, wherein said hinge is connected between said operation button and a bottom side of said frame member.

12. The structure according to claim 10, wherein said engagement slot comprises an engagement hole formed through said bottom plate of said cabinet structure.

13. The structure according to claim 10, wherein said operation button constitutes part of an operation button assembly; and said operation button assembly further includes an upright base, said operation button projecting forward from said upright base, and an arm connected to a rear side of said upright base and extending rearward to press a switch when a push is imparted to said operation button.

14. The structure according to claim 10, wherein said frame member comprises a unitary frame member.

15. The structure according to claim 14, wherein said unitary frame member surrounds said operation button.

* * * * *